US008311233B2

(12) United States Patent
Kinghorn

(10) Patent No.: US 8,311,233 B2
(45) Date of Patent: Nov. 13, 2012

(54) POSITION SENSING USING LOUDSPEAKERS AS MICROPHONES

(75) Inventor: John Kinghorn, Brockenhurst (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 1272 days.

(21) Appl. No.: 11/720,216

(22) PCT Filed: Nov. 30, 2005

(86) PCT No.: PCT/IB2005/053991

§ 371 (c)(1),
(2), (4) Date: May 25, 2007

(87) PCT Pub. No.: WO2006/059299

PCT Pub. Date: Jun. 8, 2006

(65) Prior Publication Data

US 2008/0226087 A1 Sep. 18, 2008

(30) Foreign Application Priority Data

Dec. 2, 2004 (GB) ..... 0426448.7

(51) Int. Cl.
*H04R 29/00* (2006.01)

(52) U.S. Cl. ..... 381/59; 381/58; 381/110; 704/231; 704/246; 704/E15.001

(58) Field of Classification Search ..... 381/17–18, 381/56–59, 110, 104, 107; 704/231, 246, 704/E15.001

See application file for complete search history.

(56) References Cited

U.S. PATENT DOCUMENTS

| | | | | |
|---|---|---|---|---|
| 3,934,085 | A * | 1/1976 | Munson et al. | 381/57 |
| 5,255,326 | A * | 10/1993 | Stevenson | 381/110 |
| 6,397,186 | B1 | 5/2002 | Bush et al. | |
| 6,741,273 | B1 * | 5/2004 | Waters et al. | 348/61 |
| 6,842,510 | B2 * | 1/2005 | Sakamoto | 379/102.01 |
| 7,283,635 | B1 * | 10/2007 | Anderson et al. | 381/74 |
| 7,428,310 | B2 * | 9/2008 | Park | 381/104 |
| 2003/0031333 | A1 * | 2/2003 | Cohen et al. | 381/303 |
| 2004/0066941 | A1 * | 4/2004 | Amada et al. | 381/98 |
| 2004/0101145 | A1 * | 5/2004 | Falcon | 381/64 |
| 2004/0105555 | A1 * | 6/2004 | Stromme | 381/56 |
| 2004/0202332 | A1 * | 10/2004 | Murohashi et al. | 381/17 |
| 2005/0031143 | A1 * | 2/2005 | Devantier et al. | 381/300 |
| 2005/0071159 | A1 * | 3/2005 | Boman et al. | 704/233 |
| 2005/0195989 | A1 * | 9/2005 | Sato et al. | 381/92 |
| 2005/0253713 | A1 | 11/2005 | Yokota | |
| 2006/0083388 | A1 * | 4/2006 | Rothschild | 381/81 |

FOREIGN PATENT DOCUMENTS

EP 1443804 A2 8/2004

(Continued)

*Primary Examiner* — Disler Paul

(57) ABSTRACT

A multi-channel audio system having multiple loudspeakers is used to obtain information on the location of one or more independent noise sources within an area covered by the loudspeakers. Within the multi-channel audio system, an audio output device has an input for coupling to and receiving audio signals from one or more audio sources; an audio processing module for generating a audio drive signals and providing them on respective outputs to a number of loudspeakers. A sensing module has inputs connected to respective outputs of the audio processing module, for receiving signals corresponding to sound sensed by the loudspeakers. The sensing module includes a discriminator for discriminating between signals corresponding to the audio drive signals and sensed signals from an independent noise source within range of the loudspeakers. A position computation module determines a two or three dimensional position of each independent noise source sensed, relative to the loudspeakers. The determined positions can then be used to determine control parameters for the audio system or for other devices connected to the audio system.

24 Claims, 3 Drawing Sheets

FOREIGN PATENT DOCUMENTS

| | | | |
|---|---|---|---|
| EP | 1463379 | A2 | 9/2004 |
| EP | 1651007 | A2 | 4/2006 |
| FR | 2765766 | A1 | 1/1999 |
| WO | 2006131893 | A1 | 12/2006 |

* cited by examiner

POSITION SENSING USING LOUDSPEAKERS AS MICROPHONES

The present invention relates to audio systems using loudspeakers for generating sound output in which the loudspeakers may also be used as microphones to detect sound input.

A clear trend in the use of consumer electronics equipment is to attempt to simplify user interfaces. It is desirable, wherever possible, to enable automatic performance of 'set-up' and 'operational adjustment' type tasks that would otherwise require manual intervention by the user. This is particularly true where the adjustment tasks are complex or difficult, or where performance of the adjustments detracts from the otherwise normal use of the equipment. Examples of such adjustment tasks are the setting of audio output parameters such as balance, tone, volume, etc according to the environment in which the audio system is operating.

Some such tasks can be performed automatically or semi-automatically where it is possible and practicable for the equipment itself to establish adjustment control parameters necessary, for example by sensing of the immediate environment.

In this respect, the prior art has recognised that loudspeakers are bi-directional acousto-electrical transducers, i.e. they can also act as microphones, albeit of relatively low sensitivity. As such, the loudspeakers can also in principle be used to receive verbal instructions and commands to thereby enable control of the equipment.

For example, U.S. Pat. No. 5,255,326 describes an audio system in which a user may make adjustments to the sound output and control other functions of the audio system by making spoken commands. The spoken commands may be received by the system using the loudspeakers as microphones. US '326 also proposes using a pair of infra red sensors to detect the location of a principal listener and to use this location information to automatically adjust the left-right balance of the sound output for optimum stereophonic effect.

EP 1443804 A2 describes a multi-channel audio system that uses multiple loudspeakers connected thereto also as microphones in order to automatically ascertain relative positions of the loudspeakers within the operating area. Before use, test tones are generated by successive ones of the loudspeakers for an automated set-up procedure that determines the relative position of each loudspeaker and uses this information to adjust audio output according to one of a plurality of possible pre-programmed listener positions for optimum surround sound.

The present invention is directed to an audio system in which the loudspeakers may be used to detect, in two or three dimensions, the dynamic positions of one or more users of the system or other sound-generating object, and adjust output parameters of the system accordingly.

According to one aspect, the present invention provides an audio output device comprising:

an input for coupling to, and receiving audio signals from, one or more audio sources;

an audio processing module for generating a plurality of audio drive signals and providing said audio drive signals on respective outputs for connection to a respective plurality of loudspeakers;

a sensing module, having inputs connected to respective outputs of the audio processing module, for receiving signals corresponding to sound sensed by the loudspeakers, the sensing module including a discriminator for discriminating between signals corresponding to the audio drive signals and sensed signals from an independent noise source within range of the loudspeakers; and a position computation module for determining a two or three dimensional position of said independent noise source relative to the loudspeakers.

Embodiments of the present invention will now be described by way of example and with reference to the accompanying drawings in which.

In one aspect, a preferred embodiment offers an audio system or audio equipment which automatically offers 'personalisation' and 'positioning' functions.

In 'personalisation' functions, steps are taken to identify an individual user of the equipment, who may have particular preferences in terms of ways of control as well as access to media content. 'Positioning' is about identifying where users are in a room in which the equipment is installed, or even whether they are present at all. Armed with the information about who is where (individuals or groups), the equipment can establish optimised ways of operating to meet the requirements of the users, with minimal or no effort on their part.

As well as individuals, it can be desirable to know where portable devices might be in the home.

Audio techniques offer a potentially cheap method of achieving positioning by simply measuring the time sound takes to travel over one or more paths. Clearly, however, sound sensors are required to implement such a system, which normally implies additional microphones or ultrasonic transducers. This is inconvenient to set up, and has the further disadvantage of requiring additional communication links or connecting wires to interface with the overall system. Preferred embodiments of the invention eliminate or reduce the requirement for additional hardware, and make the implementation of positioning effortless for the end user.

From a practical point of view, many living rooms are already be equipped with multiple loudspeakers suitably positioned to give an acceptable stereo effect or surround sound effect. These loudspeakers are used as the elements of a local positioning system for individuals or equipment without the necessity for the user to bother with additional microphones, cameras, etc. The loudspeakers are used both for their normal function as generators of sound, and as microphones for sensing other sounds in the room.

Figure 1:
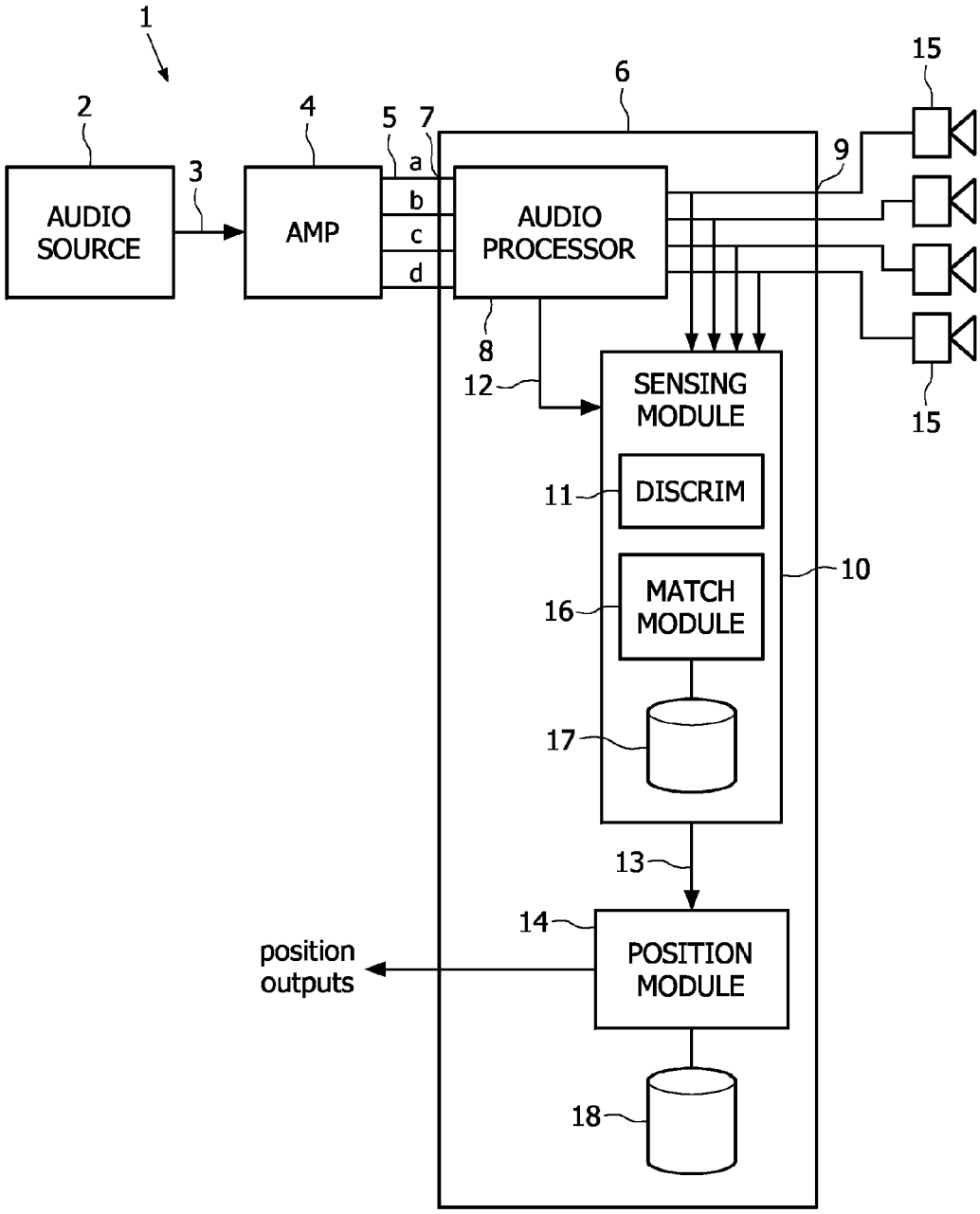
FIG. 1 is a schematic block diagram of an audio system incorporating the present invention.

With reference to FIG. 1, an audio system 1 incorporating an audio output device of the present invention is now described. One or more conventional audio sources 2 feed audio signals 3 to an amplifier 4 in conventional manner. The audio sources 2 may be analogue or digital and may include, for example, one or more of a CD player, DVD player, record player, tape player, sound server, computer system, television, multimedia centre and the like. The amplifier 4 provides audio signals 5 suitable for driving loudspeakers 15. Preferably, the amplifier provides multi-channel audio signals for quadraphonic or other surround sound system channels. In the exemplary embodiment, four channels 5*a*, 5*b*, 5*c* and 5*d* are shown.

An audio output device 6 is coupled to receive the audio signals 5 at an input 7 which is preferably multi-channel although could be a single channel input. An audio processing module 8 generates a plurality of audio drive signals on respective outputs 9 for driving loudspeakers 15. At least two outputs 9 are provided, and preferably at least three or four outputs. The audio processing module 8 may include an amplification section. More importantly, the audio processing module 8 provides an interface between the loudspeakers 15 and the audio sources 2/amplifier 4 to enable the separation of (i) signals that correspond to audio drive signals and (ii) feedback or sensed audio signals from the loudspeakers that do not correspond to the audio drive signals.

The audio processing module 8 preferably connects the loudspeakers 15 to the amplifier 4 in a manner such that the loudspeakers are driven by the amplifier with comparable results to a normal direct electrical connection, while at the same time providing an output 12 to enable a sensing module 10 to discriminate between the audio drive signals and the sensed audio signals. The sensed audio signals correspond to independent noise sources within the range of the loudspeakers and picked up by the loudspeakers acting as microphones.

Power levels obtained at a loudspeaker from 'sounds generated' by the loudspeaker compared to 'sounds detected' by the loudspeaker are typically many orders of magnitude different in amplitude. The sensing module 10 is adapted to discriminate between the two levels using one or more of several possible techniques to be described. The discrimination may be simultaneous or quasi-simultaneous discrimination between 'sound detected' signals and 'sound generated' signals, as described hereinafter. Although shown as a separate module 6, the audio processing module 8 may be incorporated within a unitary audio device or within a multimedia device incorporating an audio output section.

The sensing module 10 incorporates a discriminator 11 to isolate the sensed signals from independent noise sources on outputs 9 from the signals generated by the amplifier 4 on inputs 7. The function of the discriminator 11 may comprise a simple subtraction of the amplifier signals on input 7 from the drive signals present on output 9.

However, more preferably, it is noted that the audio drive signals themselves, when reproduced by the loudspeakers 15, may have the effect of generating echoes in the sensed signals on outputs 9 as each loudspeaker acts as a microphone to its own echoed sound and also to that received from other ones of the loudspeakers (i.e. 'cross-channel interference'). Thus, the discriminator 11 preferably also includes a signal processing module that not only subtracts the amplifier signals on input 7, but also subtracts echoed copies of the amplifier signals from the same channel and possibly also other channels, leaving only signals corresponding to sensed sound from independent noise sources.

Thus, the expression 'independent noise sources' is used to indicate sound emitting objects whose emitted sound is not attributable to, correspondent to or derived from the audio drive signals directly or indirectly. Therefore, throughout the present specification, the expression 'signals corresponding to the audio drive signals' may include not only the audio drive signals themselves, but also sensed signals directly resulting from the audio drive signals, e.g. echoes therefrom or cross-channel interference.

The sensing module 10 and discriminator 11 are capable of operating independently on each channel in order to obtain a separate discriminated signal corresponding to independent sound sources from each loudspeaker. In another arrangement, a separate sensing module 10 and/or discriminator 11 is provided for each channel. The outputs 13 of the discriminator or discriminators 11 (one per loudspeaker 15) are passed to a position computation module 14 which analyses the discriminated sounds from the independent noise sources as detected by the various speakers 15 and determines a position of each independent noise source.

The discriminator 11 can act in one or more of at least two different ways.

In a first technique, discrimination between signals corresponding to audio drive signals and signals from independent noise sources is effected by 'listening' for independent noise sources only during 'quiescent' periods of time when the audio drive signals fall below a predetermined threshold, e.g. so that signals from independent noise sources are readily identifiable without complex signal processing and analysis. The predetermined threshold may be set at any appropriate low volume.

The quiescent periods may be naturally occurring periods of, for example, a few milliseconds or more which regularly occur during speech or, for example, film soundtracks. Alternatively, or in addition, the quiescent periods may be created deliberately by periodically suppressing the audio drive signals, e.g. by switching or changing amplifier gain. This may be implemented automatically or by specific direction of a user.

In these arrangements, the discriminator 11 has a relatively simple function of only providing output when a quiescent period is indicated. This can be effected by a relatively simple relay arrangement for switching in and out the sensor module 10.

This approach of using quiescent periods has the advantage that there is no electrical mixing between the vastly different signal levels in the audio drive signals and the independent noise source signals. Acoustically, there are no sounds to be detected by the speakers when acting in 'microphone' mode except for those generated by independent noise sources in the vicinity of the speakers, after any echoes resulting from previously generated sounds from the system have died away. Disadvantages of this approach are the reliance on natural quiescent periods which may not be present in some types of audio output, e.g. music, or deliberately created quiescent periods which may be irritating to the listener if sufficiently long to be detectable within an otherwise continuous audio output.

In a second technique, discrimination between signals corresponding to audio drive signals and signals from independent noise sources is effected truly simultaneously with audio output, rather than the quasi-simultaneous time slice approach above. Discrimination is achieved by continuously distinguishing the actual movement of the loudspeaker diaphragm in comparison with the electrical audio input being fed to it. In one approach, the audio processor 8 comprises an impedance between the amplifier 4 and loudspeaker 15, wherein the incoming audio signal on input 7 is subtracted from the audio drive signal on output 9 to determine independent noise sources within range of the loudspeakers.

Impedances of loudspeakers and amplifiers are often complex and frequency dependent (being 'voltage sourced' and 'current driven') and the amplitude of the signals from independent noise sources is very much lower than the drive signal. Thus, more sophisticated signal processing techniques are preferred. These techniques may also take into account the echo signals and cross-channel interference signals as discussed above. The signal processing may also include automatic adaptation to evaluate the actual characteristics of the amplifier 4 and loudspeaker 15 combinations in use.

The position computation module 14 is adapted to determine the position of any detected independent noise sources, the signals for which are received on the outputs 13 of the sensing module 10, at least one for each loudspeaker 15.

Figure 2:
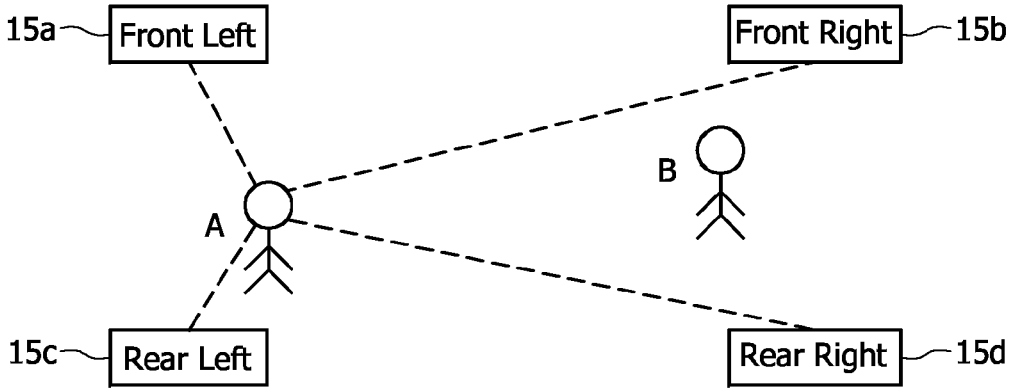
FIG. 2 is a schematic diagram useful in explaining principles of operation of the audio system of FIG. 1.

FIG. 2 shows a schematic diagram useful in describing operation of the position computation module 14 for a four-loudspeaker system. In a five-loudspeaker system, a low frequency sub-woofer speaker could be ignored.

If the person or user 'A' speaks (i.e. behaves as an independent noise source), his position, relative to the four loudspeakers 15*a* . . . 15*d*, can be detected by measuring the time taken for his voice to reach the four loudspeakers, along the paths shown by the dotted lines. If the person or user 'B' speaks, her voice will travel along different paths and take different times, allowing her position to be computed.

The time taken can be measured from any appropriate part of the speech being voiced by a user. A relatively simple solution is to detect the start of any sentence by user A or user B, by simply looking for a point at which the sound level from the user exceeds a certain threshold. More sophisticated methods may include a correlation of particular phoneme patterns, thus compensating for amplitude differences from near and remote loudspeakers which might otherwise reduce reliability.

Because the system does not know absolutely the time at which a user starts making a noise, the times measured (and consequently distances computed) to each loudspeaker from the noise source are only known in relation to each other. If, however, the system is pre-programmed with reference information indicating the real positions and distances apart of the four loudspeakers, the actual position of the noise source can be computed accurately.

In fact, the real positions of the four loudspeakers 15*a* . . . 15*d* relative to each other can be detected by the system automatically during an initial set-up procedure, using a test sequence in which each loudspeaker in turn produces a test sound, with the other three acting as microphones. By measuring the times taken for the sounds to travel between loudspeakers, their relative positions can be determined, since the speed of sound in air is fixed.

Figure 3:
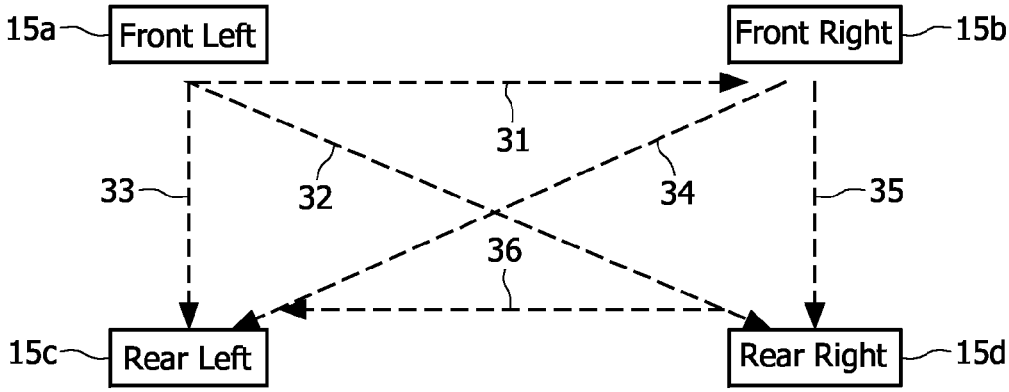
FIG. 3 is a schematic diagram useful in explaining principles of set up of the audio system of FIG. 1.

An example of the technique is described with reference to FIG. 3. The test sequence starts with the system producing a first sound burst from the front left speaker 15*a* and determining the path lengths 31, 32 and 33 by measuring the times for receipt of the first sound burst by the front right loudspeaker 15*b*, the rear right loudspeaker 15*d* and the rear left loudspeaker 15*c*. Then, the system generates a second sound burst from the front right loudspeaker 15*b* and determines the path lengths 34 and 35 by measuring the times for receipt of the second sound burst by the rear left loudspeaker 15*c* and the rear right loudspeaker 15*d*. Finally, the system generates a third sound burst from the rear right loudspeaker 15*d* and determines the path length 36 by measuring the times for receipt of the third sound burst by the rear left loudspeaker 15*c*.

It will be understood that the order and combinations of measurements may be varied. The sound bursts could also be produced simultaneously if different frequencies are used so that simultaneous detection is possible. Further checks with the loudspeaker combinations varied or reversed can be used to validate the results or improve accuracy, if desired.

Reflections, echoes and acoustic damping within the room in which the loudspeakers are located can give a wide variety of signals sensed by the loudspeakers. Nevertheless, it can be safely assumed that the direct path is the shortest path, and if the system measures only the first (fastest) response to a sound burst stimulus and ignore any subsequent inputs then the path lengths can be computed with confidence.

The test sequence could be initiated at infrequent intervals, or just done once on switch-on of the audio system, unless the positions of the loudspeakers are to be varied frequently. The test sequence causes all the path lengths between all pairs of loudspeakers to be calculated, allowing their position to be 'fixed' in the memory 18 of the position computation module 14. This, the position computation module preferably stores a reference map for determining absolute positions of detected independent noise sources from sound measurements received by each speaker 15 in the system.

The relative locations of the loudspeakers 15 do not have to be in a rectangular or regular pattern for this system to work.

For ease of accurate loudspeaker position sensing and minimum disturbance to users, preferred sound bursts during set-up are at a relatively high frequency (e.g. approximately 16 kHz) and at a low acoustic level to be beyond most people's range of hearing, but well able to be detected by the loudspeakers.

It is noted that subsequent use of the system to determine the positions of independent noise sources is not restricted to the area bounded by the four loudspeakers. Sounds originating from outside the area will still have different path lengths and delay times allowing the position to be computed.

Once set up, the sensing module 11 and position computation module 14 work in much the same way whether detecting the position of an independent noise source that is a person or an object. The person or object makes a sound. Some particular point or points in time in that sound is identified using a variety of possible techniques, and the relative time for that point to arrive at the four loudspeakers is measured. By simple geometry, the position of the person or object is calculated, as the system already knows how far apart the loudspeakers are. That position information is then used by the system in a variety of ways to influence its functionality.

An important aspect is that the system can be configured to use at least three, four or more loudspeakers for both sound production and sensing. This enables accurate determination of the position of an independent noise source in two or three dimensions, a feature which is not provided in prior art systems, e.g. as described above. Where the loudspeakers 15 occupy the same plane, e.g. a horizontal x-y plane a few tens of centimeters above floor level (as is conventional for surround sound systems), the system can accurately determine an independent noise source's position in at least x and y. Positioning a loudspeaker out of the plane defined by at least three other loudspeakers enables three dimensional position sensing to be implemented. In some conventional surround sound systems, it is customary to use four loudspeakers placed at the same height in a rectangular configuration as exemplified by FIGS. 2 and 3, and a sub-woofer or central loudspeaker placed on the floor either behind the rectangular configuration or in front of the rectangular configuration, e.g. below a television screen, for dialogue. This difference in level allows full three dimensional position sensing to be implemented.

Figure 4:
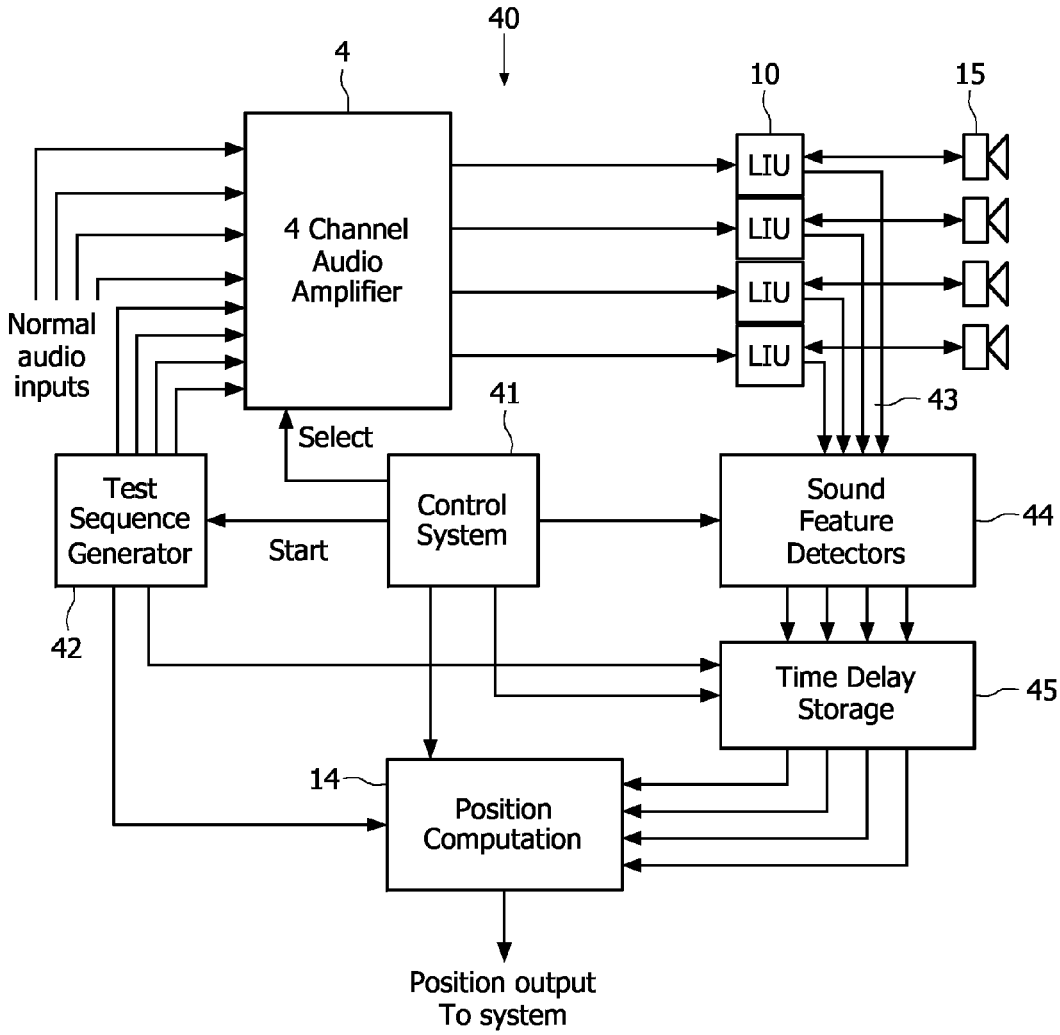
FIG. 4 is a schematic block diagram of another audio system incorporating the present invention.

An outline block diagram for a typical implementation of the system as described above is shown in FIG. 4. The system 40 operates as follows.

A controller 41 initiates the test sequence, either at switch-on or at infrequent intervals, by activating a test sequence generator 42. The inputs of the audio amplifier 4 are briefly connected to the test sequence generator 42 which produces a pattern of audio signals as described above. This causes each loudspeaker 15 to generate sound bursts in sequence, the other loudspeakers detecting the sounds. The detected sounds are sensed and discriminated by the sensing modules and discriminators 10 (shown as loudspeaker interface units) for each channel. The discriminated signals 43 for each channel are passed to respective sound feature detectors 44.

Each sound feature detector identifies a particular point in the discriminated sound waveform (e.g. the beginning of a sine wave burst), and sends out a trigger signal when it has done so. The timing of this trigger signal is compared with a reference 'start' trigger signal from the test sequence generator provided by controller 41, which gives the time delay of the sound across the current path being tested. The results of these timing measurements are calculated and stored in the time delay storage block 45 which, after the test sequence is completed, has a record of all the time delays for the acoustic paths which were tested (i.e. between all pairs of loudspeakers).

The position computation module 14 receives information from the time delay storage block 45 resulting from the test sequence, and uses it to calculate the distances between the loudspeakers. This information is retained within the position computation module 14 for subsequent use. Effectively it allows a reference map of the loudspeaker 15 layout in the room to be defined, the framework within which the positions of subsequently sensed sounds will be placed.

After the test sequence is complete, the system 40 reverts to a normal operating mode during which the positions of independent noise sources can be determined. In this normal operating mode, the controller 41 does not select the test sequence generator 42, but may reconfigure the sound feature detectors 44 to look for particular types or patterns of sound (if these are different from the types or patterns of sound produced in the test sequence). For example, the sound feature detectors may be reconfigured to look for a low frequency voice or cough with a moderate level, instead of the low level 16 kHz sine wave burst used in test mode. Thus, in a general aspect, the sound feature detectors 44 also include one or more signal processors for identifying one or more characteristic portions of independent noise source signals so that those characteristic portions may be used to determine relative time differences.

In the normal operating mode, appropriate sounds picked up by all four loudspeakers 15 are recognised by the sound feature detectors 44, each of which triggers at a time corresponding to the length of time taken for the sound to travel from its source to the relevant loudspeaker. This information is stored in the time delay storage block 45 and, in turn, is passed to the position computation module 14.

Although now the time delays of the detected sound are only relative to each other (there is no equivalent of a 'start' trigger signal from the test sequence generator for independent noise sources), the position computation module 14 already knows the absolute distances between the loudspeakers. It can therefore compute the absolute position of the sound source which has been detected. This position information (in the form, for example, of x,y coordinate points relative to a baseline direction between the front left loudspeaker 15*a* and the front right loudspeaker 15*b* is then made available to the wider system or network for processing according to the requirements of the application.

Each time a relevant sound in the room is detected, the position output of the system is updated to reflect the position of the latest sound source. Preferably, the audio output device 6 includes a matching module 16 adapted to detect predetermined patterns or characteristics of sound attributable to one or more predetermined noise sources. The matching module includes a library 17 of such predetermined patterns or characteristics that can be associated with predetermined independent noise sources. Those predetermined noise sources may be persons or objects such as telephones etc, having characteristic sound patterns which may be stored as candidate matches in the library 17.

Many applications of the invention are possible of which examples are given below.

1. Automatic balance control for multi-channel audio systems: in a surround sound system with three or more loudspeakers, the system can determine the two or three dimensional position(s) of one or more users by virtue of them each making a noise (e.g. a cough or specific voice command) and can use this position information to set an optimum left/right and front/back spatial distribution of sound for the one or more users. Where the system detects two users, the system may select a spatial distribution that is optimised for a midpoint between the users. If a user moves around the room, they need only make a noise for the system to automatically readjust the optimum spatial distribution of sound. Thus, in a general aspect, the detected independent noise sources may be used to set sound balance control parameters that optimise sound spatial distribution.

2. Optimising different user preferences: a multi-channel audio system may learn the listening preferences of different users. When the system detects an independent noise source that matches a user's voice characteristics, the system may use the preferences of detected individual users and/or groups of users to optimise the sound parameters, programme material selection and balance automatically. All that is necessary is for the individuals to make some noise sufficient for the system to distinguish who is present. The audio outputs are then adjusted for optimum presentation for all users. For example, the system establishes that James, his wife Jane and small son Jack are in the room. James is in the centre, Jane is near the rear left loudspeaker and Jack is moving around between the front left and front right loudspeakers. The system has learnt that James likes to play music fairly loud, but Jane prefers it quieter and the level should be limited to protect young Jack's hearing. Consequently, the system may determine control parameters for a moderate volume level; higher bass control to compensate for the lower volume level; lower emphasis to the surround sound as Jane is near the rear left loudspeaker and would be irritated by loud noises from that source. Overall, an optimum compromise sound presentation is given to satisfy all the listeners. As with a normal learning system, the detection of the three specific people in the room could influence programme content selection too.

Another similar application could set control parameters to optimise the audio reproduction for the area occupied by the listeners. For example, the spatial characteristics of the loudspeakers might not be uniform with frequency, so if the system knows that the listeners are 30 degrees off axis from a particular loudspeaker and it also knows that high frequency response falls off by 4 dB in that position, it may adjust tone controls for that individual channel to compensate. Such a system could allow better quality sound reproduction, optimised for the positions of the listeners (and not being concerned with quality in other areas of the room).

In a similar fashion, if the listeners are detected to be far off the optimum central position in the room, the system may compensate by adding time delays to the sound signals from the nearer loudspeakers to create a better surround sound image where the listeners are located.

3. Adaptation of audio output on demand: if the system is integrated with a voice recognition system, it is possible for individual users to command the system to control audio output or control some other electronic device connected to the system. However, beyond that, the 'user' need not be a person, but could be a device. The matching module 16 may be programmed to detect, for example, a telephone ringing, a door bell ringing, a fire or smoke alarm sounding, or any other device that generates an audible 'alert' signal. In this case, the 'user preference' associated with that device is to immediately diminish the volume of the system's audio output, or shut the system off completely.

Thus, if a mobile telephone rings while the system is playing music, the system can detect the location of that telephone and perhaps who is answering it. According to the user preferences, such information may be used to adapt the audio presentation automatically. If only one person is present, the music could be paused automatically when the telephone rings and resumed when the user indicates (e.g. by whistling or when he or she returns to his or her usual listening seat). Alternatively, if multiple listeners are in the room, the system may simply fade the music down to a lower volume, or adjust the sound balance away from the area occupied by the phone.

Given suitably sophisticated audio signal processing, it is possible to create an area of sound cancellation in the area of the telephone, since the audio system knows reasonably accurately where the telephone is. The technique is similar to that used for vibration cancellation in vehicles by generating antiphase sound signals. In such a case the phasing and amplitude of the audio outputs would be specially adapted to create a 'dead spot' of approximate silence in the area of the telephone. Since the effect only works in a small area, others in the room would still hear the audio.

4. Confirmation of equipment position: the system can generally be used to confirm the position of any device capable of making a noise detectable by the loudspeakers. Such a function may be used to improve security in the case of purchasing rights to content on a mobile phone: access to the content would depend on the phone being placed near a home media centre, for example, and passing messages between them using near field communication. The audio based positioning method described in this invention could provide additional confirmation that the mobile phone was indeed near the home media centre, e.g. by triggering the telephone to initiate a particular ring tone or other noise. Thus, in a general aspect, the matching module 16 may be programmed to recognise any particular sound pattern to be generated by a communication or security device (e.g. the mobile telephone) to confirm its presence proximal to the system. Confirmation of its presence may then be used to determine a set of control parameters for enablement of a communication channel to and/or from the communication or security device and another electronic device coupled to the audio system.

5. Optimising video displays to viewer positions: some display technologies used for consumer electronic equipment have a limited viewing angle, with colour distortion or other effects when viewed from outside the recommended position. The effect in a normal living room might be a good quality display when viewed from the sofa, but a poor result when in a different part of the room. The system described above can be used to make the optimum display follow the viewer, or in the case of multiple viewers give the best compromise.

As a simple example, a flat panel display might be mounted on a motorised stand, arranged so that the display is rotated to face the viewer whenever the viewer speaks or makes a noise. Alternatively, the display technology itself may be internally electrically adjustable to produce an optimum display in the direction of the viewer without physical movement of the display housing. Thus, in a general aspect, the audio system that detects the position of one or more users may be coupled to the video display device (or form an integral part thereof) and generate a display control parameter that is a function of the position or positions of one or more viewers of the display device. It will be understood that where more that one viewer is present in different parts of the room, the control parameters may be determined according to an optimal setting of the display device for all viewers.

6. Assistance for voice recognition: voice recognition techniques are used to control certain types of devices, e.g. computer systems. Often, the voice recognition systems have to learn several individual users' characteristics to interpret their spoken commands, and have to perform this function in a relatively noisy environment where there may be multiple users and other independent noise sources around. The audio system described above is able to determine the location of specific individuals as independent noise sources to assist the voice recognition system to distinguish between two or more individuals speaking in the same session. By separating the voices by location, this clarifies the number of individuals involved and reduces the extent to which speech learning agents and voice recognition systems might be confused by misinterpreting one person's voice for another. This makes the process of identification and recognition of individuals' voices and their commands more reliable and quicker.

Other embodiments are intentionally within the scope of the accompanying claims.

The invention claimed is:

1. An audio output device comprising:

an audio processor configured to receive audio signals from one or more sources, generating a plurality of audio drive signals, and outputting said audio drive signals to a respective plurality of loudspeakers;

a sensing module configured to receive first and second signals corresponding to sound sensed by the plurality loudspeakers, the sensing module including a discriminator configured to discriminate between the audio drive signals and the first and second signals from a first noise source and a second noise source, respectively, within a range of the plurality of loudspeakers, wherein the first noise source comprises a first listener and the second noise source comprises a second listener, and the sensing module is further configured to identify the first listener and the second listener;

a position computation processor configured to determine a two or three dimensional position of the first noise source and the second noise source relative to the plurality of loudspeakers; and a user profile memory configured to store a first user preference of the first listener and a second user preference of the second listener defining a set of control parameters governing operation of an electronic device for each of the first and second listeners, wherein the sensing module is further configured to adjust a first drive signal of the plurality of audio drive signals for driving a first loudspeaker of the plurality of loudspeakers in accordance with the first user preference of the identified first listener and to simultaneously adjust a second drive signal of the plurality of audio drive signals for driving a second loudspeaker of the plurality of loudspeakers in accordance with the second user preference of the identified second listener.

2. The audio output device of claim 1, wherein the audio processor generates at least three audio drive signals.

3. The audio output device of claim 1, wherein the audio processor generates at least four audio drive signals.

4. The audio output device of claim 1, wherein the discriminator is configured to discriminate by detecting noise source signals when the audio drive signals fall below a predetermined threshold.

5. The audio output device of claim 1, wherein the discriminator is configured to discriminate by subtracting one or more versions of the audio drive signals from each other to detect noise source signals as a residual signal.

6. The audio output device of claim 2, wherein the position computation processor determines a position of the at least one noise source by determining relative differences in time of arrival of noise source signals at the sensing module.

7. The audio output device of claim 6, wherein the position computation processor includes an analyzer configured to identify one or more characteristic portions of an at least one noise source signal of the at least one noise source signals and using said one or more characteristic portions to determine said relative differences in time of arrival.

8. The audio output device of claim 2, wherein the position computation processor includes a reference map configured to determine an absolute position of the at least one noise source based on the determined position.

9. The audio output device of claim 1, wherein the sensing module further includes a comparator configured to detect predetermined patterns or characteristics of sound attributable to a predetermined noise source.

10. The audio output device of claim 9, wherein the comparator includes a library of candidate sound patterns or characteristics attributable to one or more predetermined noise sources.

11. The audio output device of claim 10, wherein the candidate sound patterns or characteristics are attributable to different users.

12. The audio output device of claim 10, wherein at least one candidate sound pattern in the library of the comparator corresponds to a sound pattern of an alert signal and a control parameter of the set of control parameters governs volume control of an audio system.

13. The audio output device of claim 12, wherein the alert signal is any one of a telephone ring, a door bell chime, a fire or smoke alarm.

14. The audio output device of claim 10, wherein at least one candidate sound pattern in the library of the comparator corresponds to a sound pattern generated by a communication or security device to confirm its presence, the set of control parameters corresponding to enablement of a communication channel to and/or from the communication or security device and the electronic device.

15. The audio output device of claim 1, wherein the electronic device is an audio system.

16. The audio output device of claim 1, further comprising a controller configured to determine a set of control parameters that simultaneously optimize sound reproduction for a plurality of listeners at identified positions.

17. The audio output device of claim 1, further comprising a video output display device and an output display controller configured to determine a display control parameter as a function of the determined position of the at least one noise source.

18. The audio output device of claim 17, wherein the display control parameter controls an optimum viewing angle of the display device.

19. The audio output device of claim 18, wherein the display control parameter controls an optimum viewing angle for the determined positions of the first noise source and a second noise source.

20. The audio output device of claim 1, further comprising a voice recognition device configured to receive spoken instructions from a selected user, wherein the voice recognition device is configured to distinguish spoken instructions of the selected user from other noise sources using the determined position of the selected user provided by the position computation processor.

21. The audio output device of claim 20, wherein the voice recognition device is assisted to distinguish between voices of two selected users by reference to the determined positions of the selected users by the position computation processor.

22. The audio output device of claim 1, wherein the position computation module is configured to simultaneously determine two or three dimensional positions of a plurality of the at least one noise source.

23. The audio output device of claim 1, wherein the device is incorporated within an audio playback system.

24. The audio output device of claim 1, wherein the position computation processor is further configured to simultaneously determine positions of the first loudspeaker and the second loudspeaker using simultaneously produced sound bursts having different frequencies.

* * * * *